US006338487B2

(12) United States Patent
Kang

(10) Patent No.: US 6,338,487 B2
(45) Date of Patent: Jan. 15, 2002

(54) GAME SYSTEM SHOOTING AT THE TARGET BY MEANS OF A PNEUMATIC GUN

(75) Inventor: Woong Seok Kang, Kyomun-Dong (KR)

(73) Assignee: Andamiro Company, Ltd., Seoul (KR)

( * ) Notice: Subject to any disclaimer, the term of this patent is extended or adjusted under 35 U.S.C. 154(b) by 0 days.

(21) Appl. No.: 09/785,648

(22) Filed: Feb. 16, 2001

Related U.S. Application Data

(62) Division of application No. 09/192,667, filed on Nov. 14, 1998, now Pat. No. 6,217,026.

(51) Int. Cl.[7] ..... A63B 63/00; A63B 67/00

(52) U.S. Cl. ..... 273/368; 273/359

(58) Field of Search ..... 273/359, 368, 273/378, 380, 400, 408

(56) References Cited

U.S. PATENT DOCUMENTS

| | | | |
|---|---|---|---|
| 191,345 A | 5/1877 | Hoshall | |
| 1,547,834 A | 7/1925 | Smookler | |
| 1,736,244 A | 11/1929 | Baker | |
| 1,851,647 A | 3/1932 | Remonte | |
| 1,916,590 A | 4/1933 | Tratsch | |
| 2,006,180 A | 6/1935 | Price et al. | |
| 2,006,955 A | 7/1935 | Kolar | |
| 2,232,743 A | 2/1941 | Swenson | |
| 3,388,910 A | 6/1968 | Horta | |
| 3,503,614 A | 3/1970 | Suroff et al. | |
| 4,234,084 A | 11/1980 | Hutten | |
| 4,380,339 A | 4/1983 | Jones, Jr. | |
| 4,408,693 A | 10/1983 | Brewaeys et al. | |
| 4,781,289 A | 11/1988 | Perkins | |
| 4,807,886 A | 2/1989 | Van Elderen et al. | |
| 4,863,054 A | 9/1989 | Capetta | |
| 5,251,906 A | 10/1993 | Heller et al. | |
| 5,280,919 A | 1/1994 | Graham | |
| 6,217,026 B1 * | 4/2001 | Kang | 273/368 |

FOREIGN PATENT DOCUMENTS

| | | |
|---|---|---|
| JP | 56-150591 U | 11/1981 |
| JP | 61-136788 U | 8/1986 |
| JP | 61-136789 U | 8/1986 |
| JP | 5-337246 A | 12/1993 |
| JP | 5-337246 | 12/1993 |
| JP | 5-337247 | 12/1993 |
| JP | 5-337247 A | 12/1993 |
| JP | 6-491 U | 1/1994 |
| JP | 6-91052 A | 4/1994 |
| JP | 6-39071 U | 5/1994 |

OTHER PUBLICATIONS

Exhibition at Pak–Mann Amusement located at 22 N. Green Wood Ave, Pasadena, CA 91107; Nov. 3–9, 1998, No Documents.

Exhibition at Redondo Beach Pier Arcade located at 100 Fisherman's Wharf, Redondo Beach, CA 90277, Nov. 10–20, 1998, No Documents.

* cited by examiner

*Primary Examiner*—Jeanette Chapman
*Assistant Examiner*—M. Chambers
(74) *Attorney, Agent, or Firm*—Testa, Hurwitz & Thibeault, LLP

(57) ABSTRACT

The present invention disclose a game system in which a player shoots at a moving target with a bullet by means of a pneumatic gun. An embodiment of the invention includes a present-supply device having a plurality of holders, a plurality of targets, the target hanging a present and being made of materials which can be easily torn out, the targets being mounted on the holder, and a driving means for moving the holders. Further, it includes a present-delivery device for delivering the present separated from the holder when the target is torn out by its hit to a player, a bullet-supply device for feeding back the shot bullet to the pneumatic gun and a bullet-select device for selecting a proper bullet preserving the original shape, which is arranged between the present-delivery device and the bullet-supply device.

5 Claims, 13 Drawing Sheets

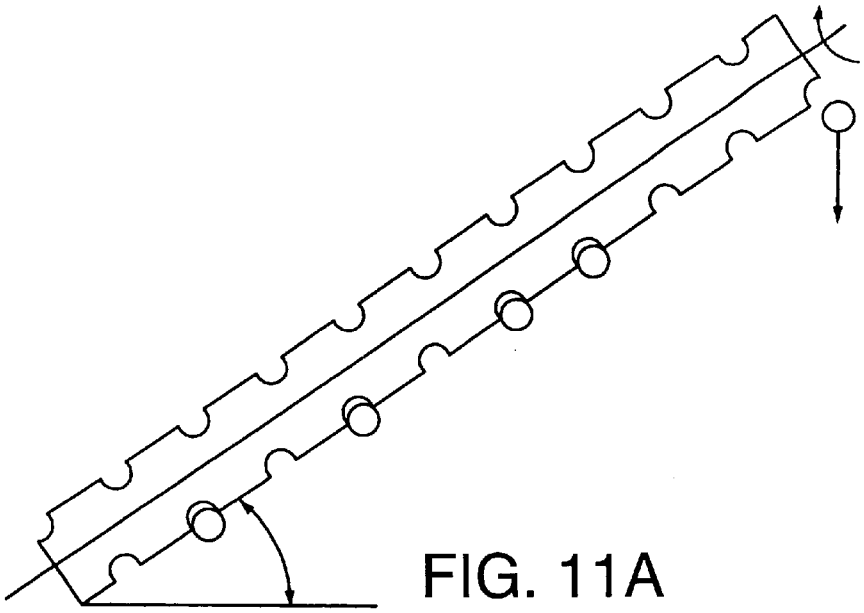
FIG. 11A
FIG. 11B
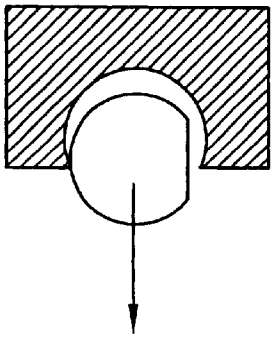
FIG. 11C
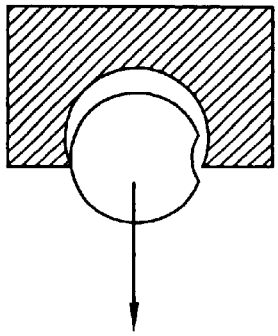
FIG. 11D
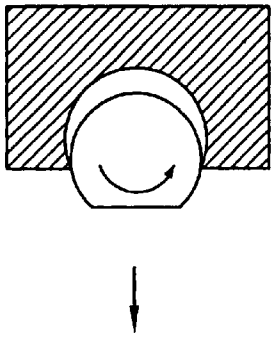
FIG. 11E
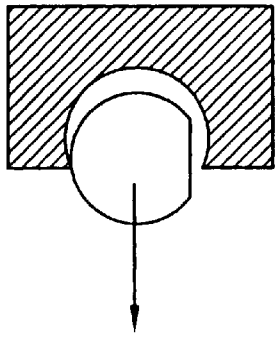

GAME SYSTEM SHOOTING AT THE TARGET BY MEANS OF A PNEUMATIC GUN

RELATED APPLICATIONS

This is a divisional of prior application Ser. No. 09/192,667, filed on, Nov. 14, 1998, now U.S. Pat. No. 6,217,026 the entire disclosure of which is incorporated by reference herein.

BACKGROUND

The present invention relates to a game system in which a player shoots at a moving target with a bullet by means of a pneumatic gun.

There are game systems in which a player shoots at the target in front of him or her with a bullet by means of a pneumatic gun. Such a kind of game systems may be found, for example, in the game room or in the theme park. Some of them have the moving targets and provide the player with a present when he or she hits the target.

In the above game systems, it will be desirable if a player can directly choose a present corresponding to one of the targets. Further, it will be also desirable if the present can be delivered to the player right after the target corresponding to the chosen present is hit. In view of the maintenance and the administration of the game system, it will be very advantageous if a lot of presents and targets can be mounted on it at a time. In addition, in the game system, it will be desirable if the player can freely move the pneumatic gun without fixing it since it may feel the player to do a real shooting, which increases amusement.

A game system shooting at the target with a bullet by means of a pneumatic gun may have a device for supplying the bullets for the gun. In such a system, it may be required to supply only proper bullets preserving the original shape. That is, because there may be broken bullets and various other materials than the bullets, it is necessary to select proper bullets from them and provide the gun with only the proper bullets.

SUMMARY

The present invention is directed to a game system shooting at the target by means of a pneumatic gun that satisfies these demand and necessities. Therefore, it is an object of the present invention to provide a game system shooting at targets by means of a pneumatic gun in which a player can directly choose a present corresponding to one of the targets, the targets moving in the game system. Another object is to provide the game system in which the present can be delivered to the player right after the target corresponding to the chosen present is hit. Still another object of the present invention is to provide the game system which can mount a lot of the presents and the targets at a time.

In another aspect, it is an object of the invention to provide a game system shooting at targets by means of a pneumatic gun in which a player can freely move and shoot the gun at the target without fixing it. Also, it is another object to provide a game system shooting at targets by means of a pneumatic gun which can supply only proper bullets preserving the original shape for the gun.

A game system shooting at targets by means of a pneumatic gun having features of the present invention has a present-supply device. The present-supply device includes a plurality of holders; a plurality of targets, the target having a present and being made of materials which can be easily torn out, the targets being mounted on the holder; and a driving means for moving the holders. In addition, the game system has a present-delivery device for delivering the present to a player and a bullet-supply device for feeding back the shot bullet to the pneumatic gun. Furthermore, the game system has a bullet-select device for supplying the gun with only proper bullets preserving the original shape. The device removes broken bullets or other materials than the bullets to select the proper bullets. The device is arranged between the present-delivering device and the bullet-supply device in the travelling path of the bullets.

By the present-supplying device, the targets, each having the corresponding present, continuously moves on the holders as the driving means drives the holders. Since each of the target has the corresponding present, it is possible to directly choose a target according to the present which the player wants. When the player chooses the target for the present and shoots at the target, several times hit of the target make it torn out since it is made of materials in capable of being easily torn away such as paper. Then, the present is separated from the holder. The separated present from the holder is transferred to the present-delivery device by its gravity and the present-delivery device delivers the present to the player. The shot bullet is also fallen down to the present-delivery device and then transferred to the select device, which selects the proper bullets preserving the original shape. The select device also remove the other materials than the bullets. The bullet-supply device feeds back the selected proper bullets to the gun. Therefore, the player can have fun with this game system to shoot at the moving targets and obtain a present which he or she wants. Furthermore, since on the present-supply device a lot of the targets and the presents can be mounted, and only the proper bullets is supplied for the gun, it is very advantageous to maintain and administrate the game system, which increases the quality of a shooting game.

In the game system, transparent covers which cover the targets and their presents but expose the hitting parts of the targets may be provided in the holders in order to protect the presents when the shot bullets are deviated from the target.

In one embodiment of the present invention, the driving means for moving the holder in the present-supply device includes a pair of gears connected through a chain and a motor for driving the gears. The motor drives the gears, and the holders accordingly make a revolutionary movement. In one embodiment of the present invention, the bullet-select device includes a selection rod having a recess formed spirally along its circumference, a motor for rotating the selection rod, and a panel for supporting the selection rod and the motor, in which the size of the spiral recess is a little smaller than the diameter of the bullet. The bullet having departed from the present-delivery device is drawn into the recess of the selection rod. Since the selection rod is continuously rotated by the motor, the bullet is moved along the spiral of the rod and the bullets not preserving the original shape are removed downside. Therefore, only the proper bullets preserving the original shape are selected and transferred to the bullet-supply device. In one embodiment of the present invention, the bullet-supply device includes a bullet-reception section for receiving the bullets, a solenoid device mounted below the bullet-reception section and a block for supporting the bullet-reception section and the solenoid device, the block having a motor. The solenoid device has a solenoid, a solenoid arm which is withdrawn to the solenoid side when the solenoid turns 'on' and a resilient means between the solenoid and the solenoid arm. In addition, the bullet-reception section has a handle, the handle having a sweeper and being connected to the motor of the block, and at the base of the bullet-reception section is formed a first penetration hole in communication with space between the solenoid and the solenoid arm of the solenoid device. The block has a second penetrating hole in communication with the pneumatic gun, the hole having a bullets-sensing sensor therein and being connected to an air pressure supply means in its one side. A compressor can be used as the air pressure supply means. The bullets selected via the bullet-select device are transferred to the bullet-reception section of the bullet-supply device. The handle installed in the bullet-reception section is rotated by the motor of the block, and, therefore, the sweeper pushes the bullet into the first penetrating hole thereof. Then the bullet is transferred to the space between the solenoid and the solenoid arm through the first penetrating hole. If the solenoid device is actuated, the bullet transferred to the space between the solenoid and the solenoid arm through the first penetrating hole is pushed into the second penetrating hole due to the retraction of the solenoid arm. At this time, the bullet sensing sensor in the second penetrating hole senses the bullet and, by this, the air pressure supply means injects an air pressure into the second hole. This pressure forces the bullet to be fed back to the pneumatic gun.

Viewing the present invention in another aspect, the shot bullets are fed back to the pneumatic gun through a hose. Inside the hose is placed a chain along its longitudinal direction. As a result, the hose maintains rigidity and the player can freely move the pneumatic gun. In this case, to prevent the risk that the bullets are shot outside the shooting position, a pneumatic gun position sensing sensor for sensing that the pneumatic gun is at the shooting position is provided at the shooting position of the present game system, and the shooting is only possible when the sensor senses that the pneumatic gun is at the shooting position.

BRIEF DESCRIPTION OF THE DRAWINGS

These and other features, aspects, and advantages of the present invention will become better understood with regard to the following description, appended claims, and accompanying drawings where:

FIG. 1-A is a view showing a box and a present supply device installed inside the box in accordance with an embodiment of the present invention;

FIG. 6(*b*) is a view showing the linear reciprocating motion of the frame;

FIG. 10(*b*) is a view showing the bullet-select device viewed from its below;

FIGS. 11(*a*) to (*e*) are views showing how the bullet-select device selects proper bullets;

FIGS. 13(*a*) and (*b*) are side sectional views of FIG. 12 taken along line 13—13, in which;

FIG. 13(*a*) is the view before the operation of solenoid;

FIG. 13(*b*) is the view after the operation of solenoid; and

DESCRIPTION

Figure 1:
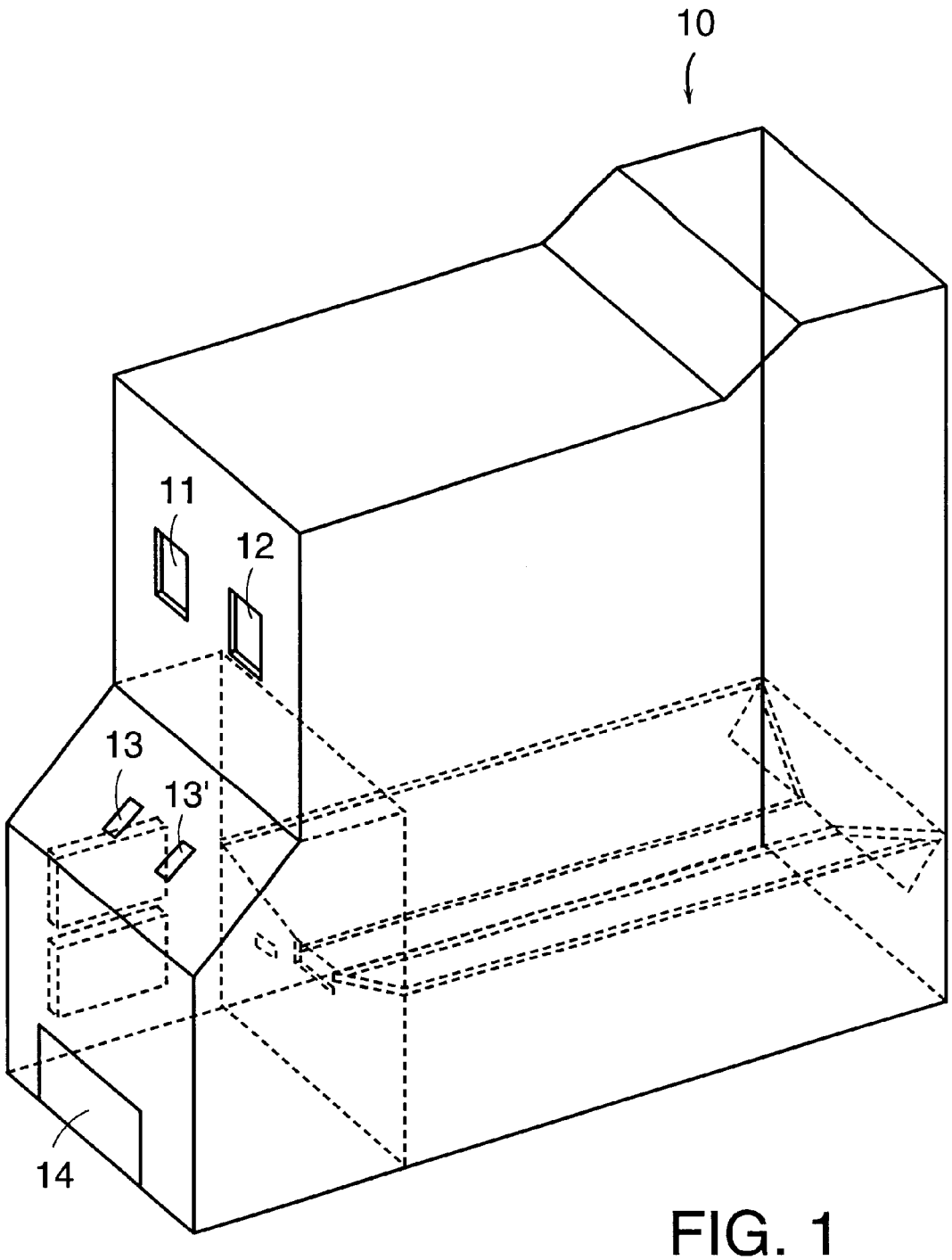
FIG. 1 is a view showing a box in which a game system according to an embodiment of the present invention is installed.
Figure 1A:
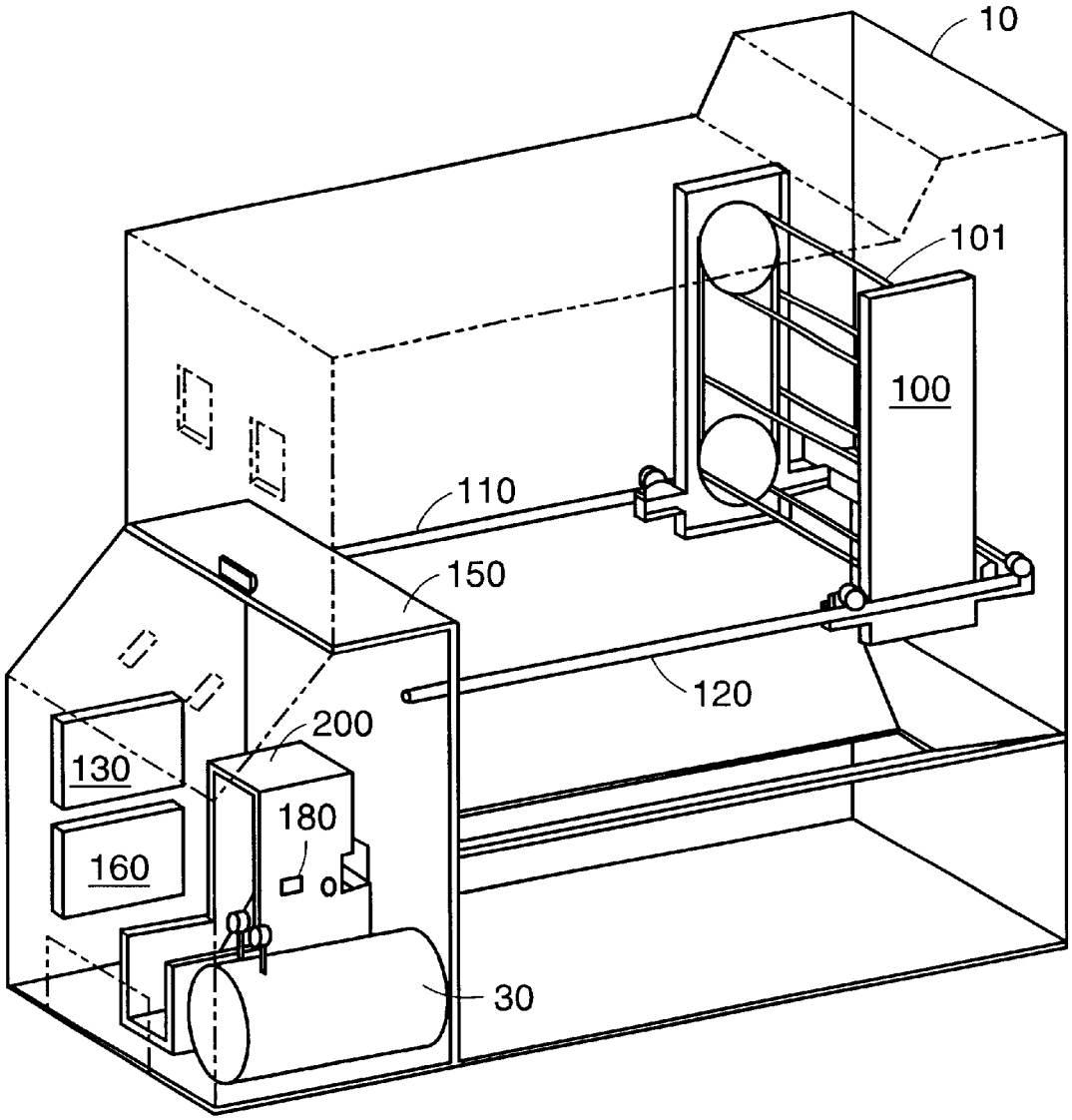

FIG. 1. shows a box 10 in which a game system according to the present invention is installed. In the front part of the box 10, there are holes 11, 12 for arrangement of a pneumatic gun. A player can place the pneumatic gun into the box 10 through the holes and, then, initiate the shooting. Below the arrangement holes 11, 12 are provided pneumatic gun storage sections 13, 13' for keeping the gun therein while the shooting is not made. At a bottom of the front part of the box 10 is provided a present receiving opening 14 through which the player can receive the present.

Figure 2:
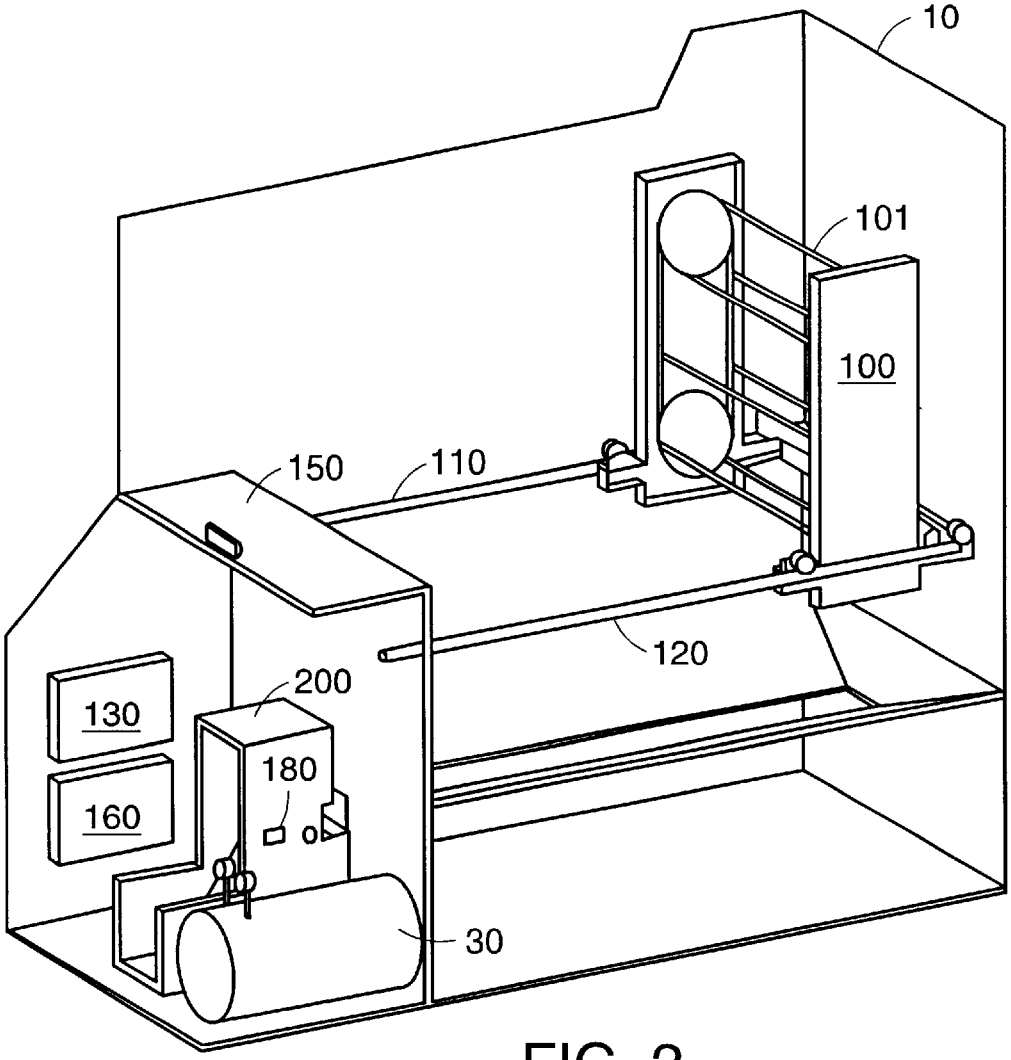
FIG. 2 is a view showing a present-supply device installed inside the box in accordance with an embodiment of the present invention.

FIG. 2 shows a present-supply device 100 installed inside the box 10 according to the present invention. The present-supply device 100 has a plurality of holders 101. A plurality of targets are mounted on each of the holder 101. The target is made of materials in capable of being easily torn out and has a present. The present is suspended from each of the targets in an embodiment of the invention. (refer to FIG. 7) For example, the target is made of paper. Several times hit of the target makes it torn out and the present is separated from the holder and fallen down. The holders 101 continuously rotate by means of a driving means in the present embodiment (Refer to FIGS. 8 and 9). In the present embodiment, the present-supply device 100 is arranged on rails 110 and 120. As described below, this is for horizontal movement of the present-supply device. Another box 200 is placed in a forward part of the interior of the box 10 for installing a bullet-supply device and a bullet select device, which will be described below. Reference number 30 denotes a compressor which is an air pressure supply means. This compressor provides air pressure for feeding back the shot bullets to the gun as described below. A power supply device 160 and a mainboard 130 electrically controlling the present game system are installed in the forward part of the interior of the box 10. A pneumatic gun position sensor 150 which senses the placement of the pneumatic gun at the shooting position is provided in the plane behind the holes 11, 12 of FIG. 1. The sensor 150 senses that the pneumatic gun is placed into the box 10 through the pneumatic gun arrangement hole 11 or 12 and the player is ready for shooting. In addition, in the box 200, a present sensing sensor 180 for sensing the delivery of the present to the player is provided as shown.

Figure 3:
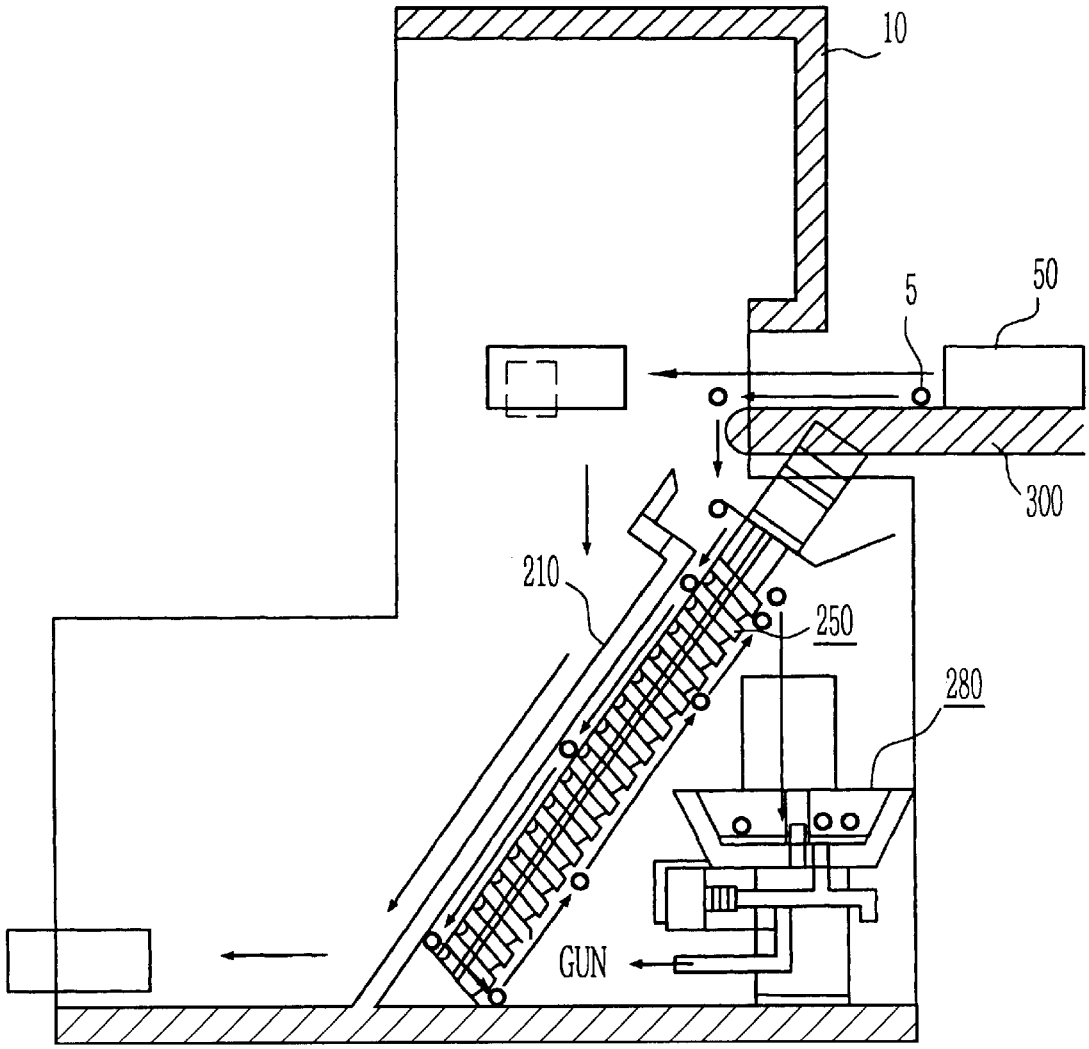
FIG. 3 is a view showing a schematic operation procedure of the present invention.

FIG. 3 illustrates an operation procedure of the present invention. In the drawing are shown embodiments of a present-delivery device 300, a bullet-select device 250 and a bullet-supply device 280. If the target mounted on the holder 101 of the present-supply device 100 is torn out by a several times of hit, then the present drops down. The dropped present 50 is fallen down on the present-delivery device 300 and is moved toward the player by the present-delivery device. In the present embodiment, the delivery device 300 is a conveyor belt. In this case, not only the present 50, but also other materials such as the shot bullet and fragments of the target occurring when the target is torn out drop down on the conveyor belt 300. The shot bullets 5 and the presents 50 are moved through the conveyor belt 300 toward the player. After that, the present 50 crosses down on an inclined plate 210 after it escapes out of the conveyor belt 300 and slides down along the inclined surface of the plate 210, and is provided for the player through front opening 14 of the box 10. The bullets and other materials drops down through a space between the conveyor belt 300 and the plate 210 to the bullet-select device 250. The bullet-select device 250 removes the broken bullets or other materials than the bullets and transfers only the proper bullets preserving the original shape to the bullet-supply device 280. The bullet-supply device 280 feeds back the bullets to the pneumatic gun by means of the air pressure of the compressor 30.

Figure 4:
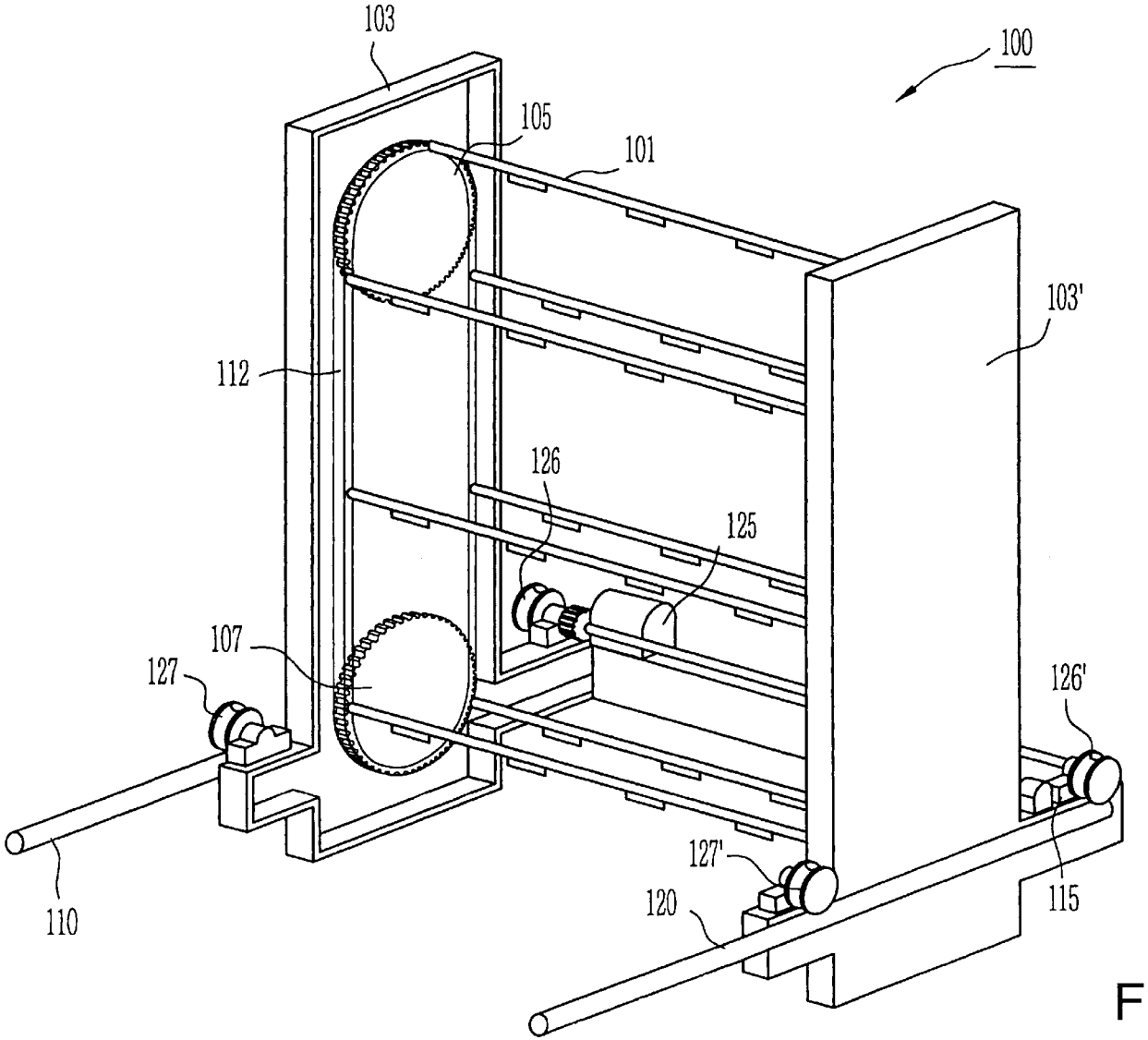
FIG. 4 is a view showing a constitution of the present-supply device according to an embodiment of the present invention.
Figure 5:
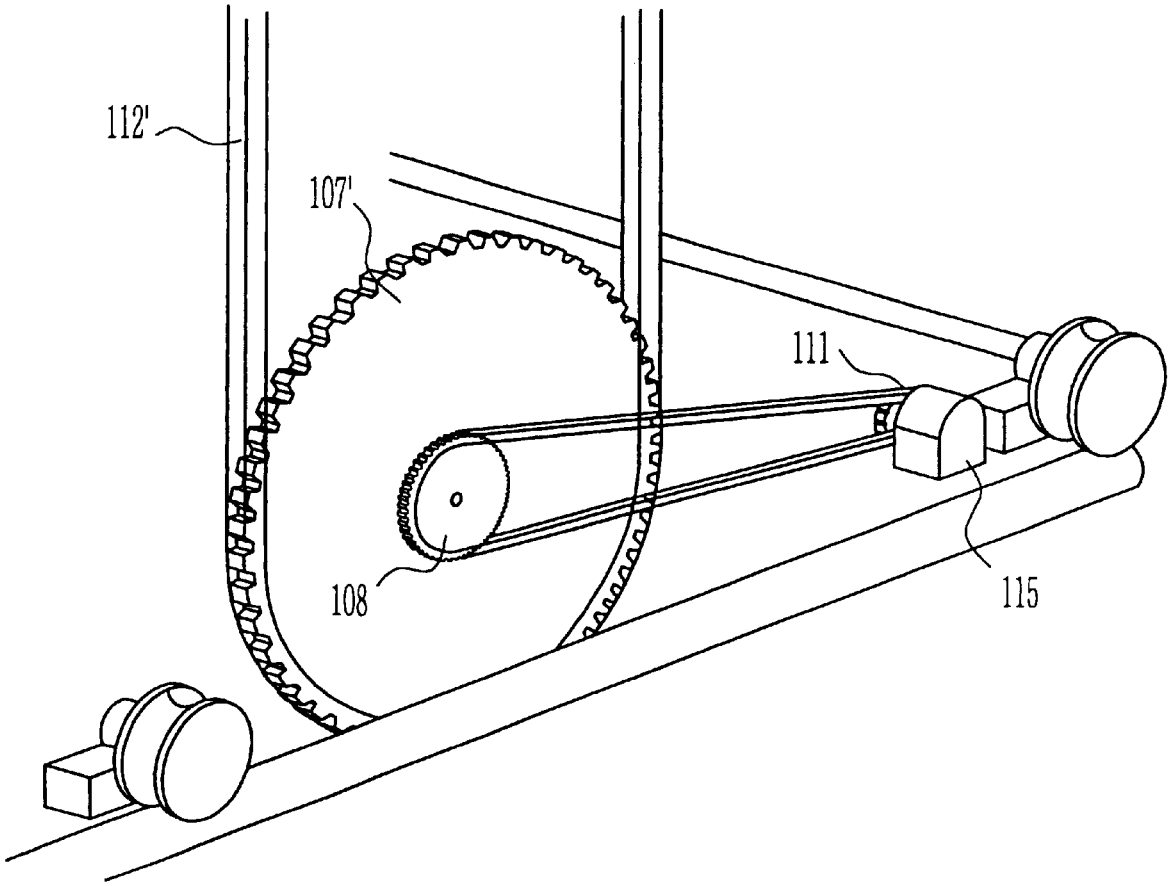
FIG. 5 is a view showing a driving mechanism of holders in the present-supply device of FIG. 4.
Figure 6A:
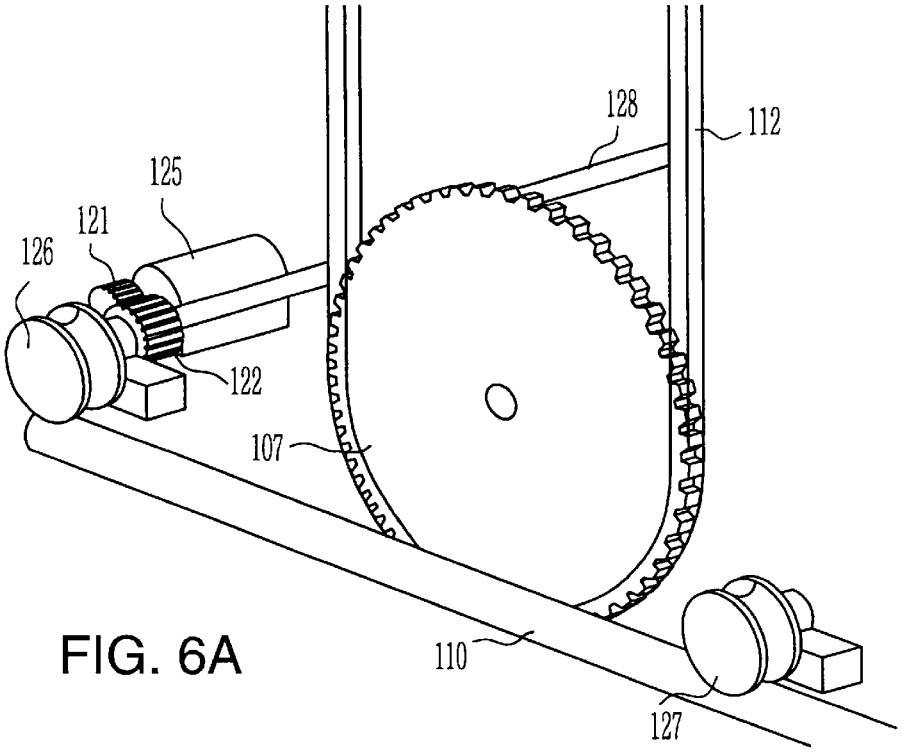
FIG. 6(*a*) is a view showing a mechanism for linearly reciprocating a frame having the holders of the present-supply device of FIG. 4.

FIGS. 4, 5 and 6 show an embodiment of the present-supply device 100.

First, referring to FIG. 4, upper gears 105,105' and lower gears are installed at frames 103,103'. The upper gear 105 or 105' at each frame 103 or 103' is connected to the corresponding lower gear 107 or 107' through a chain 112 or 112'. Each of an end of the holders 101 are fitted in respective holes formed on the chains 112, 112' so that the holders are fixed between the chains 112, 112' facing with each other as shown. The gears are driven by means of a driving motor. This example is shown in FIG. 5. A holder driving motor 115 delivers the power to the lower gear 107' through a belt 111. A portion 108 for mounting the belt 111 on the lower gear 107' is provided. Therefore, if the holder drive motor 115 is actuated, the holders are continuously rotated over from downside to upside (or viceversa). Each of the holders has a plurality of targets (not shown) below of it. As described below, the target has a present hanged below it. In addition, the target is made of material in capable of being easily torn out such as paper. Therefore, after the initiation of the shooting game, the holders are continuously rotated over from downside to upside (or viceversa) by the actuation of the holder drive motor 115, and the player can shoot at the target having a present which he or she wants. By this, the player can obtain a double amusement, one is shooting at the moving target and the other is obtaining a desiring present at the same time. The mechanism for rotating the holders in up-down relation was explained, however, it is apparent that a person having an ordinary skill in the art can easily change this mechanism to rotate the holders in horizontal relation.

Figure 6B:
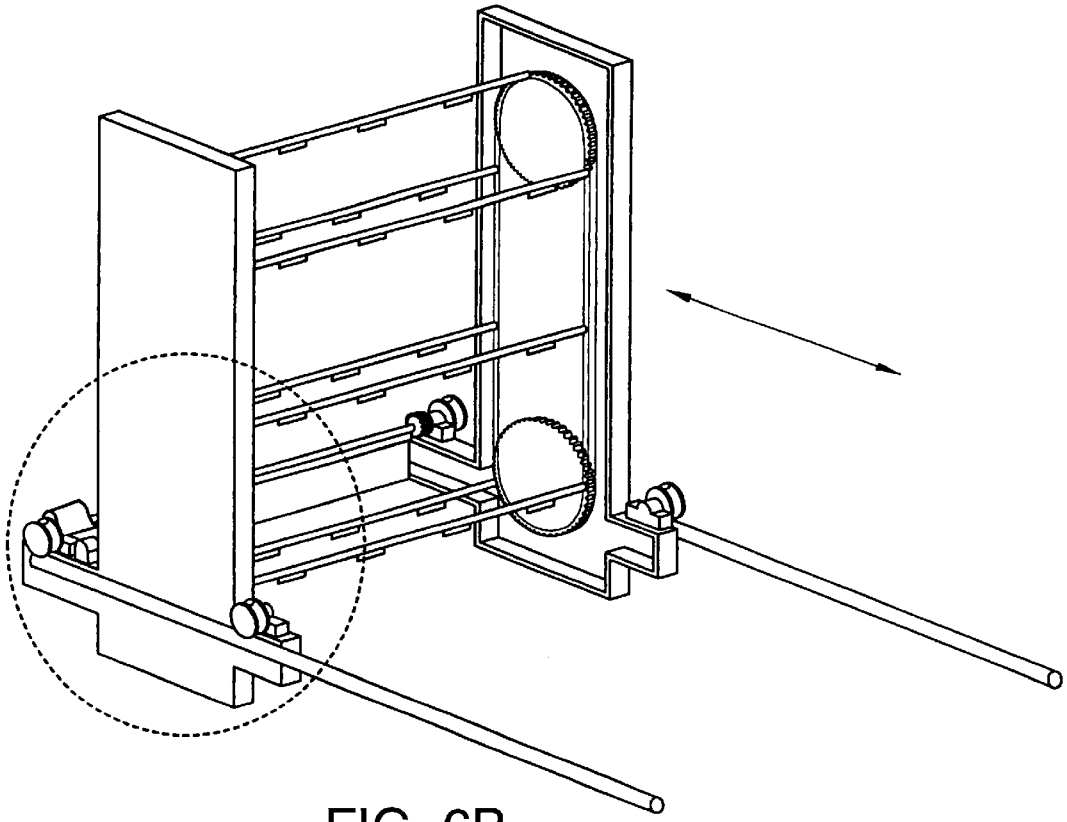

In view of administration, when the targets are almost disappeared from the holders by the hits (accordingly, the presents are almost disappeared too), new targets must be mounted on the holders. For this purpose, it will be desirable if the present-supply device 100 can be moved to the front of the game machine box 10. FIGS. 4 and 6 also show an embodiment which satisfies such need. The frames 103, 103' are installed on the rails 110, 120, respectively. The frames do a linear reciprocating motion on the rails. For the linear reciprocating motion, a frame reciprocation motor 125 is installed on the frame 103, and the power of the motor is transmitted to a roller 126 on the rail 110 through pinion gears 121, 122. The roller 126 is connected to a roller 126' of an opposing frame through a pinion shaft 128. The frames 103 and 103' also have idle rollers 127 and 127', respectively. Therefore, as shown in FIG. 6B, the frame moves linearly on the rails 110, 120 when the motor 125 rotates. The rotational direction of the motor will determine the linear-motion direction of the frame. As described above, the shooting game system of the present invention can load a lot of present at a time because the present-supply device 100 has a plurality of holders and each holder has a plurality of targets, each of which has a corresponding present. In addition, since the present-supply device can make the linear motion to the front part of the box 10, it is comfortable to replace the presents. Therefore, it can be understood that the present invention provides a shooting game system which can mount a lot of the presents and the targets at a time and is convenient to replace the present and the targets. This is very advantageous in view of the maintenance and administration of the game system.

Figure 7:
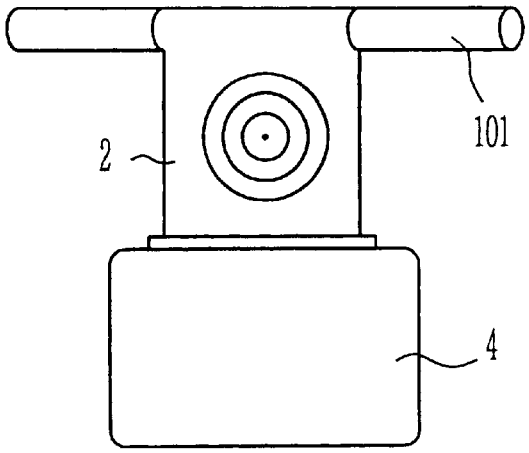
FIG. 7 is a view showing a target having a present according to an embodiment of the present invention.

FIG. 7 shows a condition in which the target of the invention is mounted on the holder 101. As shown, on the target 2 is hanged the present 4. The target is made of materials easily torn out such as paper and several times of hit (usually 10 times of hit) tear it out. Then, the present will fall down on the present-delivery device 300 such as the conveyor belt.

Figure 8:
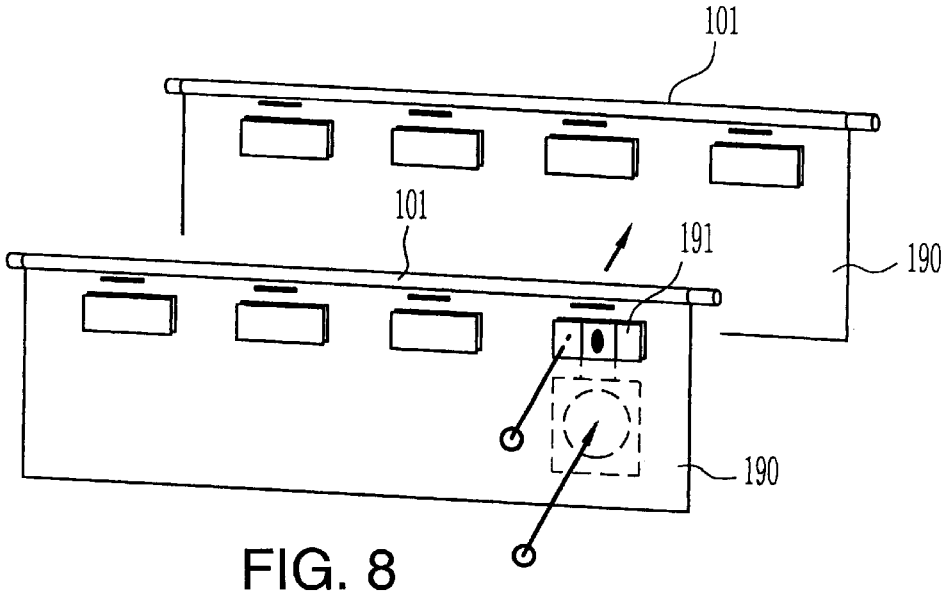
FIG. 8 is a view showing that a transparent cover is provided in the holder in accordance with an embodiment of the present invention.
Figure 9:
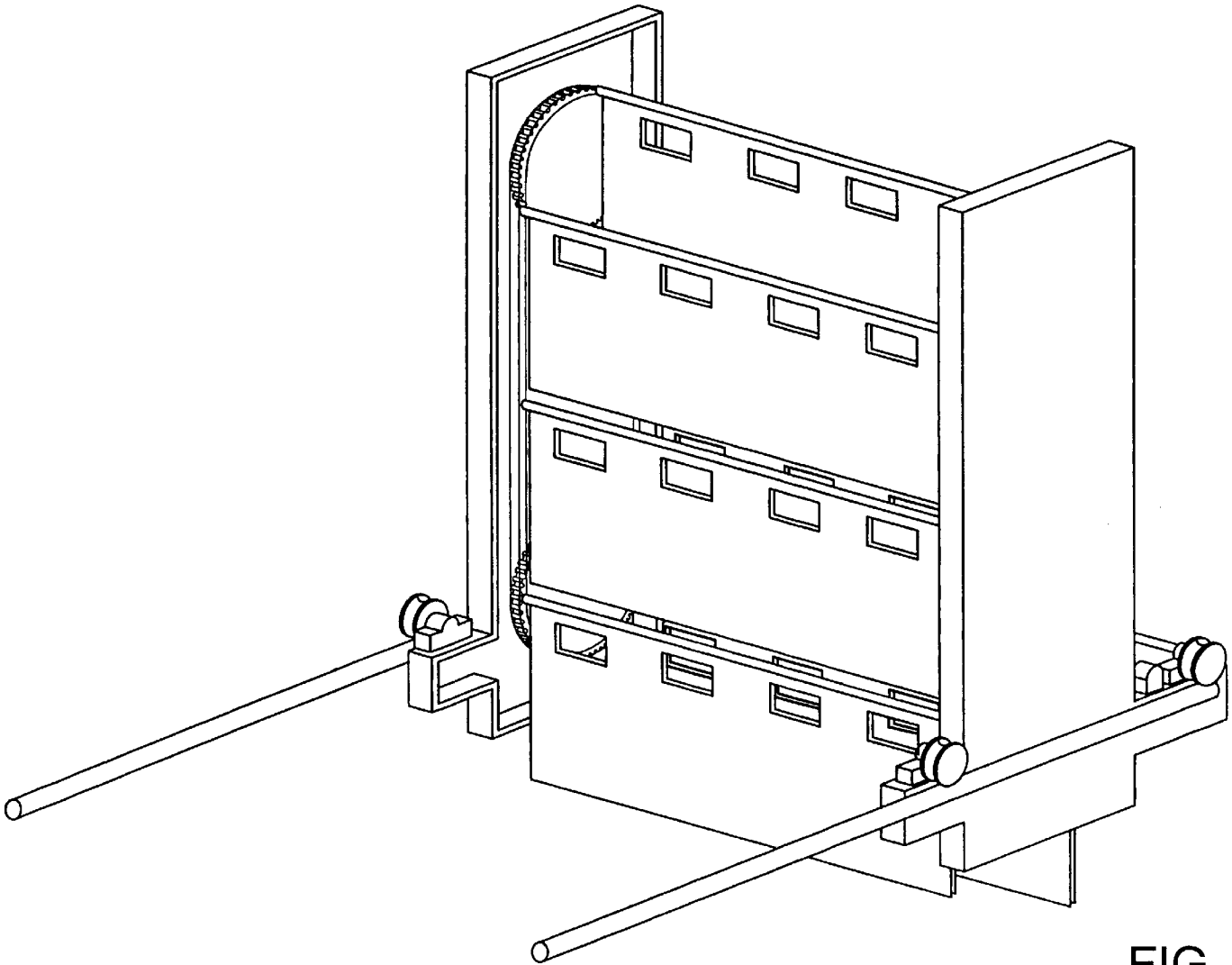
FIG. 9 is a view showing a present-supply device on which the transparent covers are installed in accordance with an embodiment of the present invention.

FIG. 8 shows that a transparent cover 190 is provided in the front of the respective holders 101. For example, a cover made of vinyl may be used for the cover 190. The cover 190 covers the targets and their presents on the hold 101 but expose the hitting parts of the targets by the cut portions 191 of the cover 190. Accordingly, the player aims at the exposed hitting portion. With this transparent cover 190, it is possible to protect the present. That means, it can prevent the shot bullets from hitting the present when the bullets are deviated from the hitting portion of the target and, in the holders revolving over with making two front and backward rows, also prevent the shot bullets which do not hit with regard to the front row from hitting the targets or present in the backward row. Thus, the player should hit the target having his or her desiring present before the target rotates over to the backward row, otherwise, he or she should wait until the target with the present comes back to the front row. FIG. 9 shows the present-supply device on which the transparent covers are installed.

Furthermore, in the present-supply device 100, position sensing sensors (not shown) may be provided in the rear portion of the frame 103, 103' and on the front inner wall of the box 10. Then, it can be known by the sensors that frame 103, 103' have arrived at the most rear portion or the most forward portion of the box. At this time, by cutting off the power to the motor 125, it is possible to save an unnecessary power consumption.

As described with reference to FIG. 3, the presents dropped down by the hits, the shot bullets and other materials are transferred by means of the conveyor belt 300, and, then, the present is delivered to the player through the inclined plate 210, and the bullets and other materials are transferred to the bullet-select device 250, which removes the broken bullets or other materials to select the proper bullets preserving the original shape.

Figure 10A:
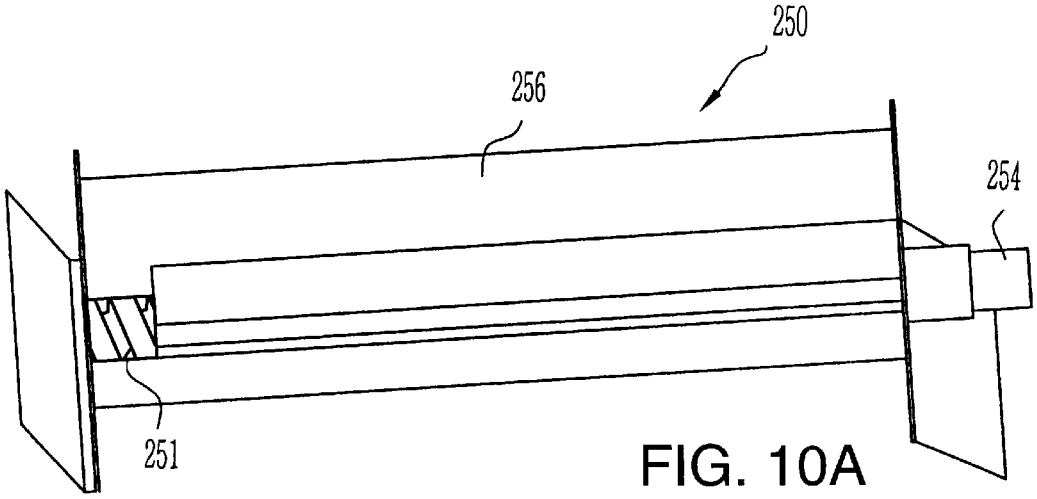
FIG. 10(*a*) is a view showing a bullet-select device viewed from its above.
Figure 10B:
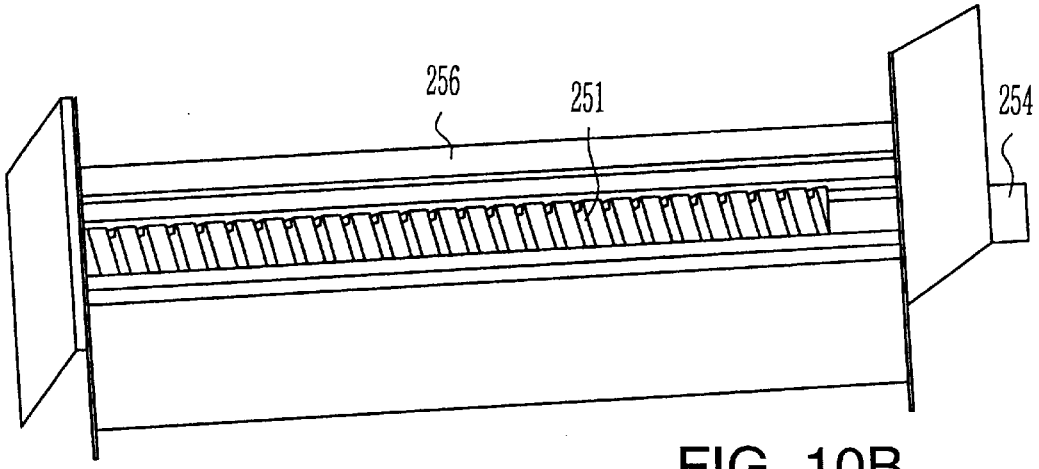

FIGS. 10 and 11 illustrate an embodiment of the bullet-select device according to the present invention. The bullet-select device 250 includes a selection rod 251, a motor 254 for rotating the selection rod 251 and a panel 256 for supporting the selection rod and the motor. FIG. 10(*a*) illustrates the bullet-select device 250 viewed from its above and FIG. 10(*b*) it viewed from its below. As best shown in FIG. 10(*b*), the selection rod 251 has a recess formed spirally along its circumference. As shown in FIG. 10(*a*), the panel 256 covers the selection rod 251 to expose only partial bottom portion of the rod 251 in the upper surface of the bullet select device 250. Also, this device is inclined with a certain degree. (refer to FIG. 11(*a*)) The bullets or other materials escaped out of the conveyor belt 300 drop to the upper surface of the selection device 250, and they slide down along the inclination of the panel and are drawn into the spiral recess of the selection rod 251 through the exposed portion of the panel 256. The bullets drawn into the bottom part of the spiral recess of the selection rod 251 move upward along the spiral since the selection rod 251 is continuously rotated by means of the motor 254. The spiral recess of selection rod 251 has a size which is a little smaller than the diameter of the bullet. The bullet climbs up from along the spiral as the rod 251 rotates, and escapes from the recess when it reaches the upper end of the spiral recess of the rod 251. In this process, the bullet rotates about its own axis due to the vibration of the selection rod 251 and the friction between the bullet and the wall in the spiral recess (refer to FIG. 11(*d*)), and the bullet which is broken and does not preserve the original shape cannot stay in the spiral recess during its climbing up but falls down before arriving at the upper end. (refer to FIGS. 11(*a*), (*b*), (*c*), (*d*) and (*e*)) Although the explanation was given about the bullet, it is clear that other materials than the bullets can be filtered in the same way. By this, only the selected proper bullets are transferred to the bullet-supply device 280, which feeds back the bullet to the pneumatic gun by means of the air pressure of the compressor 30.

Figure 12:
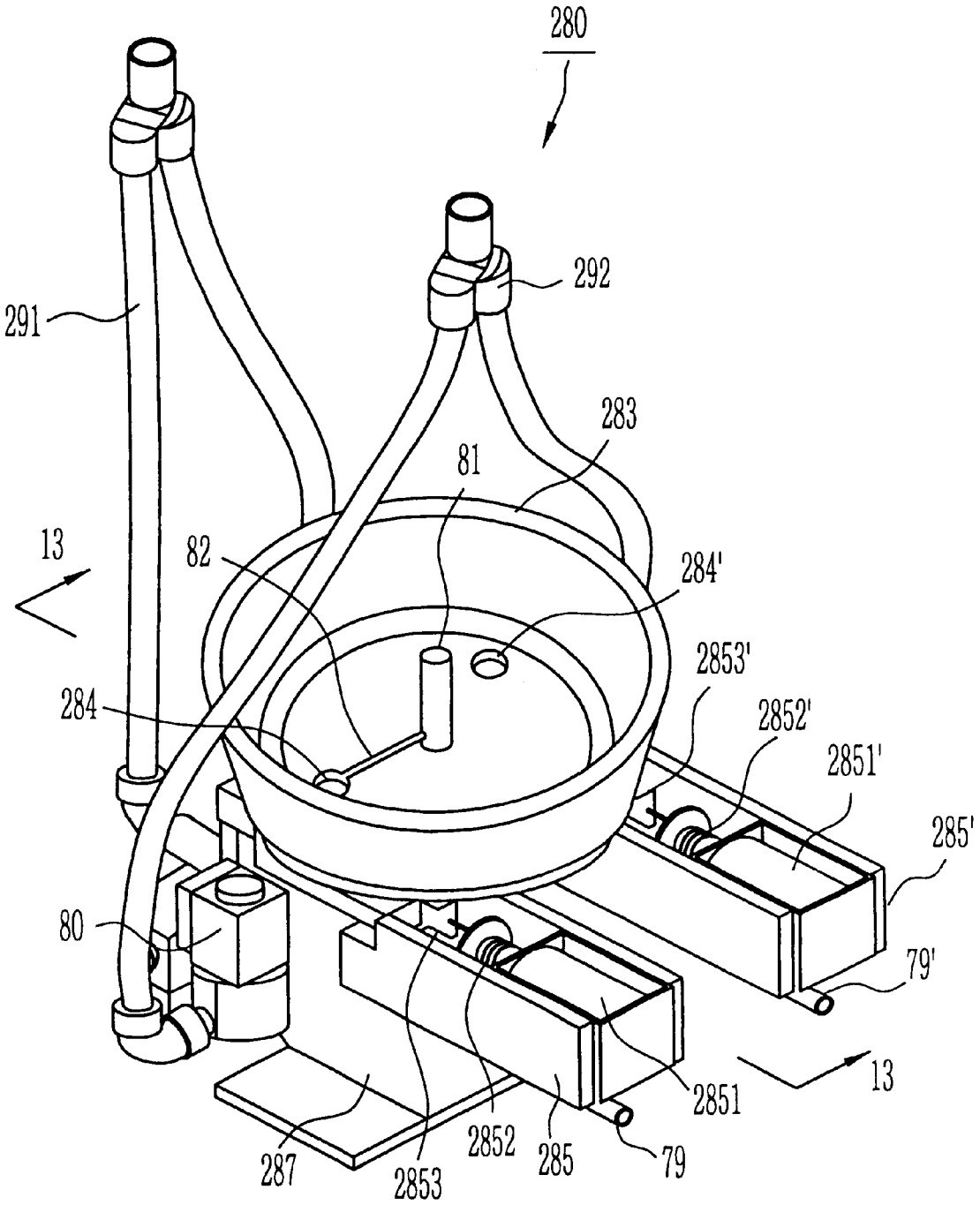
FIG. 12 is a perspective view of a bullet-supply device according to an embodiment of the present invention.
Figure 13A:
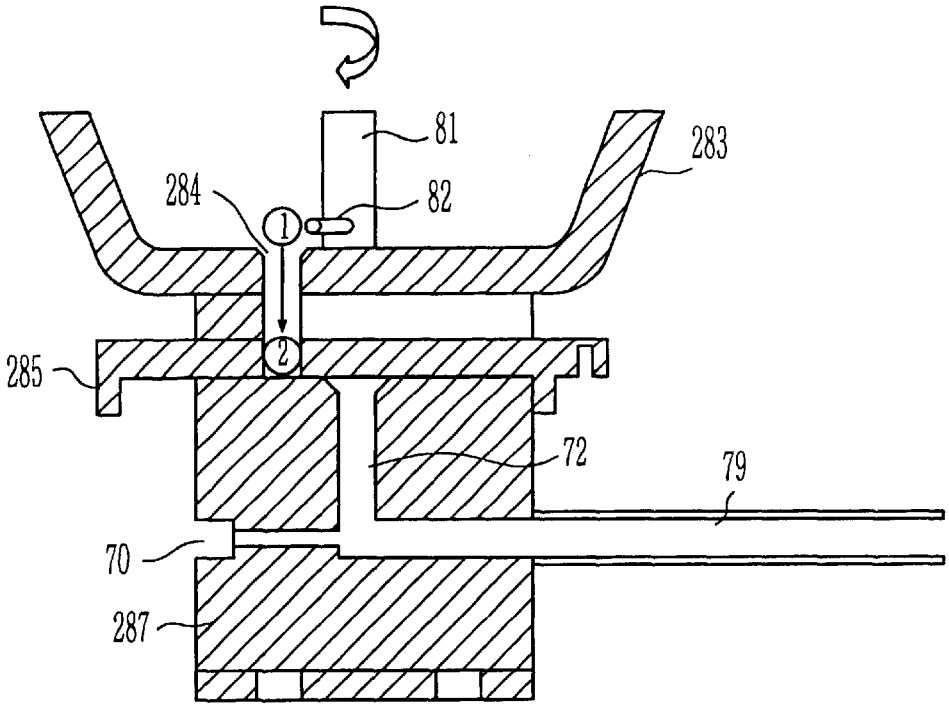
Figure 13B:
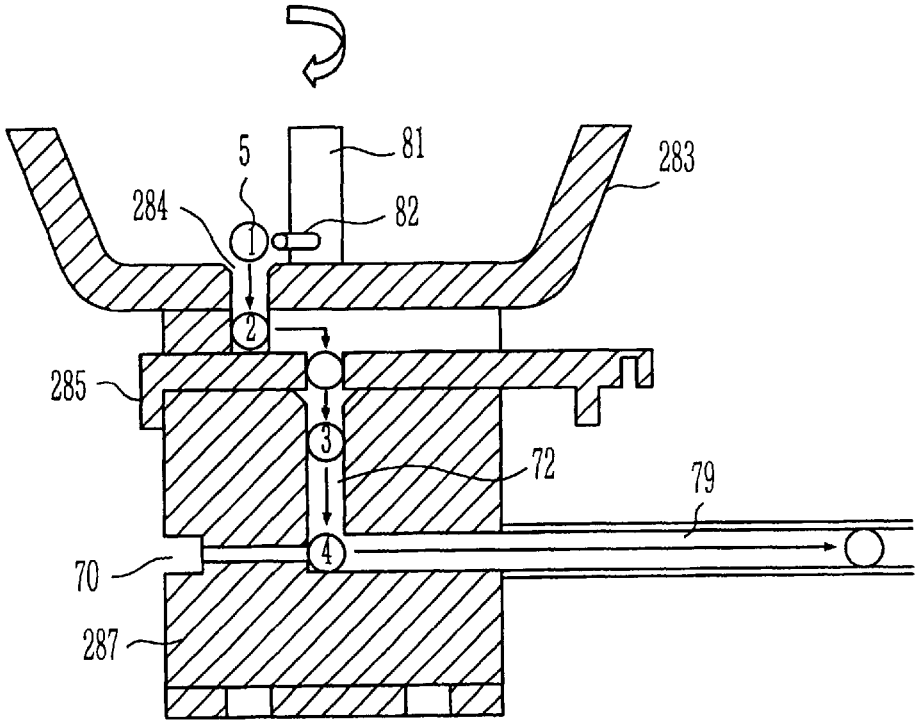

FIGS. 12 and 13 show an embodiment of the bullet-supply device 280. FIG. 12 is a perspective view of the bullet-supply device and FIGS. 13 (*a*) and (*b*) are side sectional view of FIG. 12. The bullet supply-device 280 includes a bullet reception section 283 for receiving the bullet escaped from the bullet select-device 250 and a block 287 placed below the bullet reception section 283. The bullet reception section 283 has penetrating holes 284, 284' which penetrate from its base to below. The bullet reception section 283 has a handle 81 on its center, which is connected to a motor (not shown) in the block 287. The handle 81 has a sweeper 82 as shown. Solenoid devices 285 and 285' are installed on the block 287. The solenoid devices 285 and 285' have solenoids 2851 and 2851', solenoid arms 2853 and 2853', and springs 2852 and 2852', respectively, the spring arranged between the solenoid and the solenoid arm. The solenoid arm is retracted toward the solenoid when the solenoid turns 'on' and is returned to its original position by the restoring force of the spring when the solenoid turns 'off'. Each of the penetration holes 284 and 284' formed at the base of the bullet reception section 283 communicates with a space formed between the solenoid and the arm. The block 287 has a vertical penetration hole 72 which communicates with the pneumatic gun through a communication line 79. The vertical penetration hole 72 communicates with the compressor 30 through hose 291, 292. Reference number 70 denotes a communication portion in the block 287 to which the hoses are connected. To the communication portion 70 are simultaneously connected a high pressure hose 291 and a low pressure hose 292 by means of a valve 80. In the vertical penetration hole 72 is installed a bullet sensing sensor (not shown) for sensing the arrival of the bullet. FIGS. 13(*a*) and (*b*) illustrate the operation of the supply device. In the drawings, the number noted inside the bullets indicates the position of the bullet. With reference to FIG. 13(*a*), a handle 81 of the bullet reception section 283 is rotated by the motor of the block and, accordingly, rotates the sweeper 82 so as to push the bullet dropped into the reception section into the penetration hole 284 or 284'. As a result, the bullet moves to the first position as shown. Then, the bullet drops along the penetration hole 284 or 284' and arrives at the space between the arm and solenoid at the solenoid devices 285, 285'. That is, the bullet arrives at the second position as shown. With reference to FIG. 13(*b*), after the bullet arrives at the second position, the solenoid turns 'on' and the solenoid arm is retracted, and as a result, the bullet is pushed into the penetration hole 72 of the block. Thus, the bullet arrives at the third position. At this time, the solenoid turns off and the solenoid arm which has been retracted returns back to the original position by the restoration force of the spring. When the bullet reaches the third position, the bullet sensing sensor senses the arrival, and the low pressure air supplied from the compressor through the low pressure hose 292 is injected into the communication portion 70 of the block. Consequently, the bullet is supplied to the pneumatic gun through the communication line 79. If the bullet is not fed back to the pneumatic gun in spite of the several times of actuation of the solenoid, the high pressure air is injected into the communication portion 70 through a high pressure hose 291. This assures the feed back of the bullet to the gun in the penetration hole 72 of the block or in the connection line 79 between the penetration hole 72 and the pneumatic gun.

Figure 14:
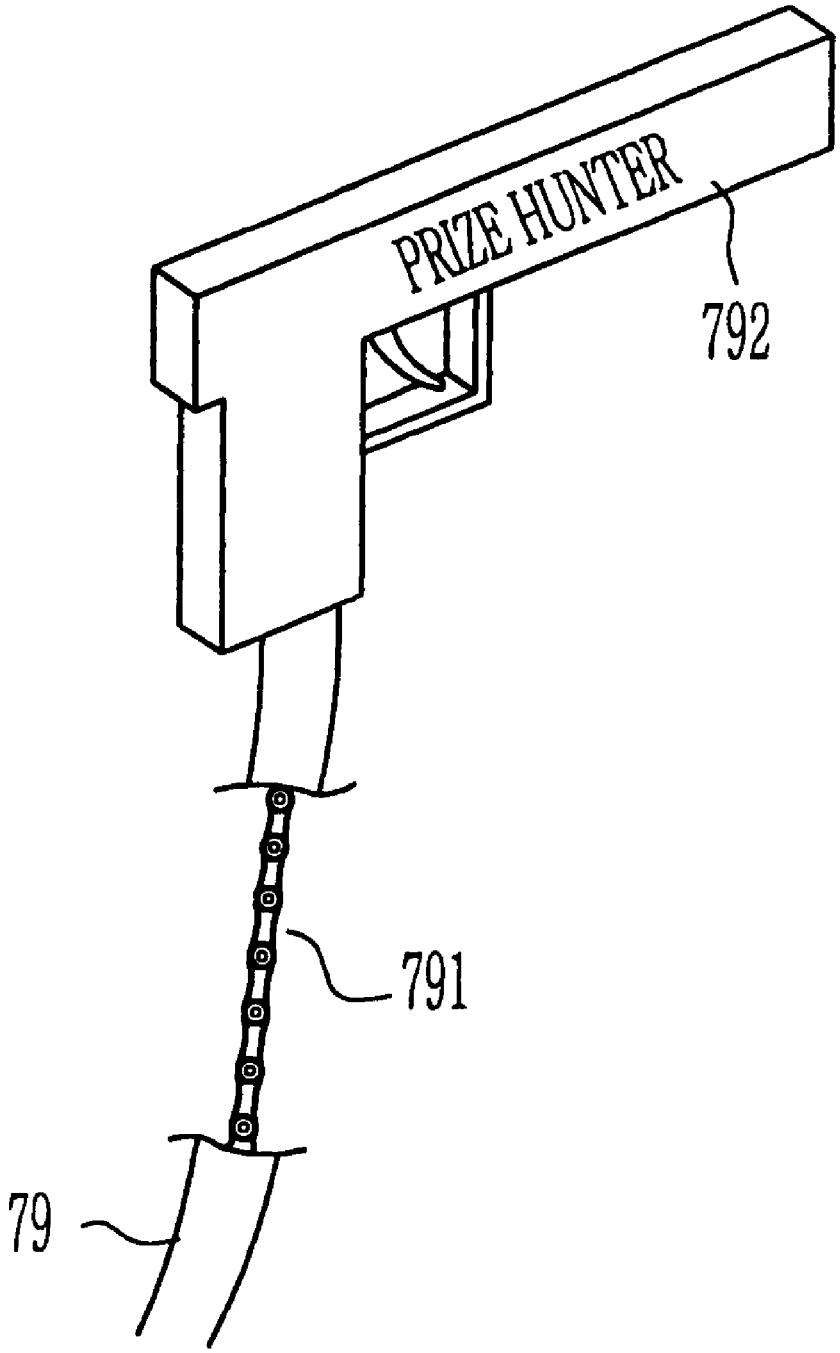
FIG. 14 is a view showing a communication line connecting the bullet-supply device with a pneumatic gun which is cut in its midway.

FIG. 14 shows the communication line 79 connecting the bullet-supply device 280 to the pneumatic gun, which is cut in its midway. The communication line is a hose, and in the hose 79 is installed a chain 791 along its longitudinal direction. The installation of the chain 791 assures that the player freely moves the pneumatic gun 792. If a pneumatic gun is connected by means of the hose 79 without the chain, the hose 79 is likely to be twisted when the player moves the gun. However, the installation of the chain 791 in the hose 79 prevents such phenomenon, and the player can enjoy the game much more interestingly. The pneumatic gun position sensor 150 (FIG. 2) arranged below the pneumatic gun arrangement holes 11, 12 senses that the pneumatic gun is at the shooting position. That is, the sensor 150 senses that the player places the pneumatic gun into the hole and is ready for shooting. The gun is actuated only when the sensor 150 sensed that the gun is at the shooting position. Therefore, in the system as the present invention in which the player can freely move the shooting gun, it is possible to exclude the risk that the bullets are shot at the position other than the shooting position. The present sensing sensor 180 is for sensing the delivery of the present to the player. By this, it is possible to inform the player of the delivery of the present. For example, it is possible to sound a music when the sensor 180 senses the present.

It will be understood that the objects described above are accomplished by the present invention. While the present invention has been described and illustrated herein with reference to the preferred embodiment thereof, it will be understood by a person having ordinary skill in the pertained art that various changes in form and details may be made therein without departing from the spirit and scope of the invention.

What is claimed is:

1. A game system shooting at targets with a bullet by means of a pneumatic gun comprising:

a pneumatic gun;

a plurality of bullets for the gun;

a present-supply device including:

a plurality of targets;

a plurality of holders;

a plurality of presents;

each of the presents coupled to a respective one of the plurality of targets, each of the plurality of targets removably coupled to one of the holders, wherein the target is made of a material that tears when struck by a bullet;

a driving means for moving the holders;

a present-delivery device for delivering the present to the player when the target is torn by a shot bullet;

a bullet-supply device for feeding back the shot bullet to the pneumatic gun; and a bullet-select device between the present-delivery device and the bullet-supply device for transferring bullets that preserve their original shape to the bullet supply device; and a pneumatic gun position sensing sensor provided at the shooting position of the game system for sensing the arrangement of the gun at the shooting position whereby the shooting is only possible when the sensor senses that the pneumatic gun is placed at the shooting position.

2. The game system as set forth in claim 1, wherein the bullet-select device comprises a selection rod having a recess formed spirally along its circumference, a motor for rotating the selection rod, and a panel for supporting the selection rod and the motor, the size of the spiral recess being a little smaller than the diameter of the bullet.

3. The game system as set forth in claim 1, wherein the bullet-supply device comprises:

(a) a bullet-reception section for receiving the bullets;

(b) a solenoid device mounted below the bullet-reception section, the device including a solenoid, a solenoid arm which is withdrawn toward the solenoid when the solenoid turns on, and a resilient means between the solenoid and the solenoid arm;

(c) a block having a motor, the block for supporting the bullet-reception section and the solenoid device: in which, the bullet-reception section has a handle, the handle having a sweeper and being connected to the motor of the block, and at the base of the bullet-reception section is formed a first penetration hole in communication with space between the solenoid and the solenoid arm of the solenoid device; and the block has a second penetrating hole in communication with the pneumatic gun, the hole having a bullet-sensing sensor therein and being connected to an air pressure supply means in its one side; whereby the bullet received in the bullet-reception section is transferred to the space between the solenoid and the solenoid arm through the first penetration hole by the operation of the sweeper when the motor drives the handle; the bullet is drawn into the second penetrating hole when the solenoid arm is withdrawn to the solenoid arm by the actuation of the solenoid; and the bullet is fed back from the second penetrating hole to the gun by means of an air pressure injected by the air pressure supply means when the bullet sensing sensor senses the bullet in the second penetration hole.

4. The game system as set forth in claim 1, wherein the shot bullet is fed back to the gun through a hose, the game system characterized in that inside the hose is placed a chain along its longitudinal direction so that the hose maintains rigidity and the player can freely move the gun.

5. The game system as set forth in claim 1, wherein the bullet-select device comprises a selection rod having a recess formed spirally along its circumference, a motor for rotating the selection rod, and a panel for supporting the selection rod and the motor, the size of the spiral recess being a little smaller than the diameter of the bullet.

* * * * *

UNITED STATES PATENT AND TRADEMARK OFFICE

CERTIFICATE OF CORRECTION

PATENT NO. : 6,338,487 B2
DATED : January 15, 2002
INVENTOR(S) : Kang

It is certified that error appears in the above-identified patent and that said Letters Patent is hereby corrected as shown below:

Title page,
Item [56], References Cited, U.S. PATENT DOCUMENTS, please add the following:
-- 626,500 A 6/1899 McCullough --

Signed and Sealed this

Twenty-first Day of October, 2003

JAMES E. ROGAN
*Director of the United States Patent and Trademark Office*